US006301812B1

(12) United States Patent
Klunk

(10) Patent No.: US 6,301,812 B1
(45) Date of Patent: Oct. 16, 2001

(54) GIFT CONTAINER AND ASSOCIATED METHODS

(76) Inventor: Richard Klunk, 3900 Chelsea St., Orlando, FL (US) 32803

( * ) Notice: Subject to any disclaimer, the term of this patent is extended or adjusted under 35 U.S.C. 154(b) by 0 days.

(21) Appl. No.: 09/664,027

(22) Filed: Sep. 19, 2000

(51) Int. Cl.[7] ..... G09F 1/00; G09F 11/21

(52) U.S. Cl. ..... 40/124.06; 40/124.2; 40/514; 283/117

(58) Field of Search ..... 40/124.01, 124.06, 40/124.2, 514, 515, 516, 517, 661, 700, 721, 722, 725, 765, 776; 283/117

(56) References Cited

U.S. PATENT DOCUMENTS

| | | | | |
|---|---|---|---|---|
| 480,430 | * | 8/1892 | Koch | 40/517 |
| 948,506 | * | 2/1910 | Horton | 40/514 |
| 1,966,276 | | 7/1934 | Armstrong . | |
| 2,337,210 | | 12/1943 | Soldati . | |
| 2,490,621 | | 12/1949 | Colomer . | |
| 3,426,461 | * | 2/1969 | Miller | 40/471 |
| 3,471,957 | | 10/1969 | Robb . | |
| 3,711,976 | | 1/1973 | Allen . | |
| 5,282,537 | | 2/1994 | Wong . | |
| 5,359,797 | * | 11/1994 | Williamson | 40/517 X |
| 5,497,876 | | 3/1996 | Fleming . | |
| 5,596,828 | * | 1/1997 | Smallwood | 40/518 X |
| 5,622,264 | | 4/1997 | Wetterlund . | |
| 5,641,062 | | 6/1997 | Burton et al. . | |

FOREIGN PATENT DOCUMENTS

| | | | | |
|---|---|---|---|---|
| 2459733 | * | 7/1976 | (DE) | 40/517 |
| 612084 | * | 10/1926 | (FR) | 40/514 |
| 1098788 | * | 4/1955 | (FR) | 40/514 |

* cited by examiner

*Primary Examiner*—Brian K. Green
(74) *Attorney, Agent, or Firm*—Allen, Dyer, Doppelt, Milbrath & Gilchrist, P.A.

(57) ABSTRACT

A combination gift container and photo album includes a housing defining a chamber therein and having a slot-shaped opening in an outer surface thereof and in communication with the chamber. An inner spindle is carried by the housing in the chamber, and a medium is connected to the inner spindle to be wound around the inner spindle and withdrawn from the chamber via the slot-shaped opening in the outer surface of the housing. The medium includes a greeting card, and a plurality of pockets, preferably transparent pockets, connected together lengthwise. Each of the pockets has an appropriate size to selectively receive a monetary gift and a photograph. The monetary gift preferably comprises paper money, checks or gift certificates. The recipient of the gift would withdraw the medium while reading the greeting card and seeing the money contained in the pockets. After taking the money out of the pockets, the recipient may then insert photographs from the occasion in the pockets so that the gift container becomes a photo-album memento of the occasion.

13 Claims, 5 Drawing Sheets

GIFT CONTAINER AND ASSOCIATED METHODS

FIELD OF THE INVENTION

The present invention relates to gift containers, and more particularly, to a container for enclosing a gift such as money, checks and/or gift certificates.

BACKGROUND OF THE INVENTION

Conventionally, gifts are given in containers such as a decoratively wrapped box or decorative bag. An example of such a box is disclosed in U.S. Pat. No. 5,497,876 to Fleming entitled "Combination gift box, greeting card, wrapping and decoration." Fleming is concerned with providing an attractive one-piece decorative gift container with enhancements, such as paper and ribbon, and an incorporated greeting card.

Another example is U.S. Pat. No. 5,282,537 to Wong entitled "Combination photo frame, gift box and greeting card." Wong discloses a combination gift article that simultaneously provides the features of a photo frame, gift box and greeting card. The combination gift article has a gift container mounted on one of the panels that may contain a small gift and/or a photograph.

In many circumstances, money, checks and/or gift certificates are given in a greeting card or envelope. This may be convenient and appropriate. However, greeting cards and envelopes are flat and may be easily misplaced or lost. Furthermore, opening a greeting card without an associated gift box or container may lack some excitement, or depending on the occasion, may be anticlimactic because the recipient is already anticipating a monetary gift. Furthermore, as soon as the recipient opens the card, the total amount of the gift is immediately apparent and the excitement is shortlived. This may discourage the giver from giving a monetary gift even when it is appropriate or even preferred to do so.

Various containers are known for enclosing money as a gift. U.S. Pat. No. 5,622,264 to Wetterlund entitled "Gift box for monetary gifts" discloses an example of a box for enclosing money as a gift. The box includes an insert with a platform having coordinated apertures for holding rolled-up paper money. Also, U.S. Pat. No. 5,641,062 to Burton et al. entitled "Combined greeting card and gift box apparatus" discloses a gift box which is formed from a foldable cardboard panel. The gift box includes a roll of tape for securing money in a coil inside the box.

However, it is desirable to provide a gift container for enclosing money, checks and/or gift certificates in a way that surprises the recipient, which includes a greeting card, which is simple to make and use, and which can be readily used again as a gift container or as a photo-album memento of the occasion.

SUMMARY OF THE INVENTION

In view of the foregoing background, it is therefore an object of the invention to provide a gift container for enclosing money, checks and/or gift certificates in a way that surprises the recipient, which includes a greeting card, which is simple to make and use, and which can be readily used as a photo-album memento of the occasion.

This and other objects, features and advantages in accordance with the present invention are provided by a combination gift container and photo album including a housing defining a chamber therein and having a slot-shaped opening in an outer surface thereof and in communication with the chamber. An inner spindle is carried by the housing in the chamber, and a medium is connected to the inner spindle to be wound around the inner spindle and withdrawn from the chamber via the slot-shaped opening in the outer surface of the housing. The medium includes a greeting card, and a plurality of pockets, preferably transparent pockets, connected together lengthwise. Each of the pockets has an appropriate size to selectively receive a monetary gift and a photograph. The monetary gift preferably comprises paper money, checks or gift certificates. A winding device, such as a knob, is connected to the inner spindle for winding the medium around the inner spindle, and a stop member is attached to a distal end of the medium and disposed outside the chamber for aiding in the withdrawal and winding of the medium. A tab may be connected to the stop member for withdrawing the gift medium from the chamber via the slot-shaped opening.

The stop member may comprise an elongated stop member which is larger than the slot-shaped opening. Also, the greeting card may be contained in at least one of the plurality of transparent pockets or it may be connected between the plurality of transparent pockets and the stop member. The housing is generally cylindrically shaped and may include decorative indicia on the outer surface thereof. Furthermore, the housing, the inner spindle and the knob may be formed of plastic.

A method aspect of the present invention is directed to making a combination gift container and photo album. The method includes forming a housing defining a chamber therein, forming a slot-shaped opening in an outer surface of the housing and in communication with the chamber, providing an inner spindle in the chamber, and connecting a medium to the inner spindle to be wound around the inner spindle and withdrawn from the chamber via the slot-shaped opening in the outer surface of the housing. Again, the medium includes a greeting card, and a plurality of transparent pockets connected together lengthwise, each of the pockets having an appropriate size to selectively receive a monetary gift and a photograph. The method further includes connecting a knob to the inner spindle for winding the medium around the inner spindle, and attaching a stop member to the distal end of the medium outside the chamber for aiding in the withdrawal and winding of the medium.

The monetary gift preferably comprises at least one of paper money, checks and gift certificates. Also, a tab may be connected to the stop member for withdrawing the gift medium from the chamber via the slot-shaped opening, and the stop member may comprise an elongated stop member which is larger than the slot-shaped opening. The greeting card may be contained in at least one of the plurality of transparent pockets or connected between the plurality of transparent pockets and the stop member. Decorative indicia may be formed on the outer surface of the housing, and the housing, the inner spindle and the knob may be formed of plastic.

Thus, a giver of the gift container would sign the greeting card and place a desired number of bills, for example, such as $5's, $10's, $20's etc., in the transparent pockets before winding the medium onto the spindle and inside the container. The recipient of the gift would pull the stop-member and/or tab to withdraw the medium while reading the greeting card and seeing the money contained in the pockets. After taking the money out of the pockets, the recipient may then insert photographs from the occasion in the pockets so that the gift container becomes a photo-album memento of the occasion.

DETAILED DESCRIPTION OF THE PREFERRED EMBODIMENTS

Figure 1:
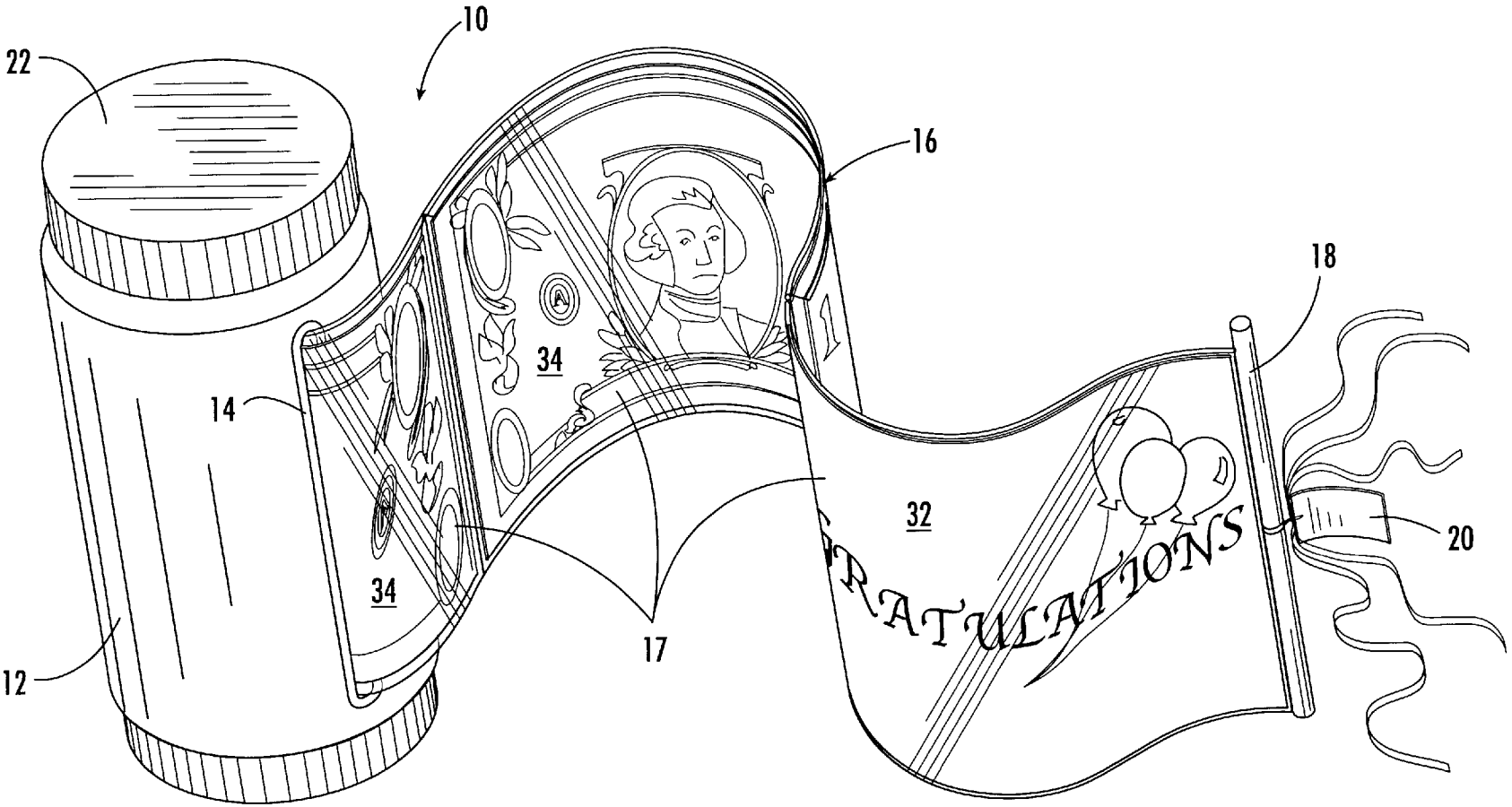
FIG. 1 is a schematic diagram illustrating the gift container of the present invention with the medium carrying money and a greeting card, and being partially withdrawn from the housing.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring to FIGS. 1–7, a combination gift container and photo album 10 in accordance with the present invention will be described. The container 10 includes a housing 12 defining a chamber 13 therein. The housing 12 has a slot-shaped opening 14 in an outer surface thereof and which is in communication with the chamber 13. An inner spindle 24 is carried by the housing 12 in the chamber 13, and a medium 16 is connected to the inner spindle to be wound around the inner spindle and withdrawn from the chamber via the slot-shaped opening 14 in the outer surface of the housing.

Figure 6:
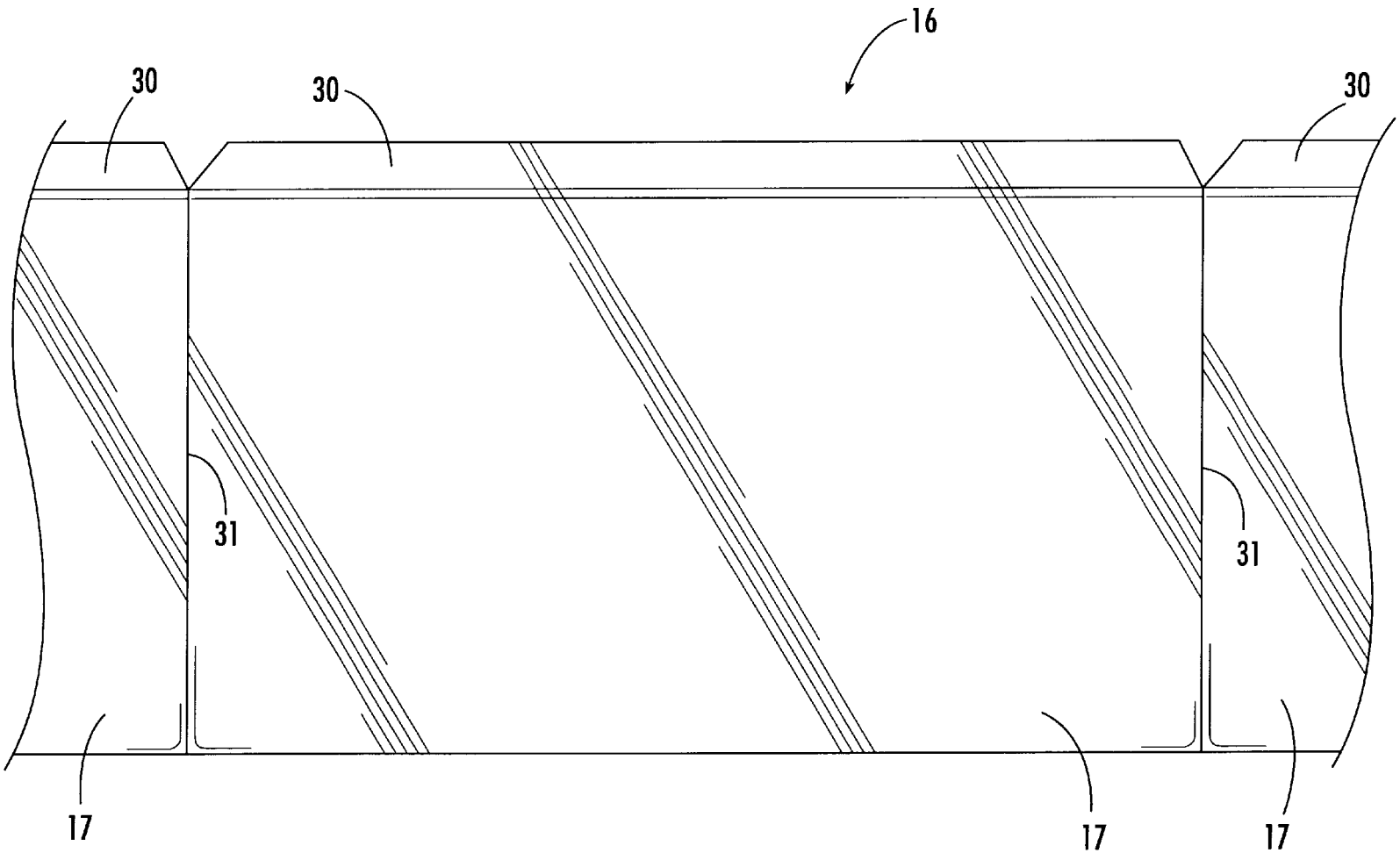
FIG. 6 is a schematic diagram illustrating the unwound empty medium of the container of FIG. 1.

The medium may include a greeting card 32, and a plurality of transparent pockets 17 connected together lengthwise. Each of the pockets 17 has an appropriate size to selectively receive a greeting card, a monetary gift and a photograph. For example, each of the pockets may be about 2–4 inches in height by 4–8 inches in length. As best shown in FIG. 6, the plurality of transparent pockets 17 may be formed with seams 31 separating the pockets and flaps 30 for securing the money or gift which is inserted into each of the pockets.

Figure 7:
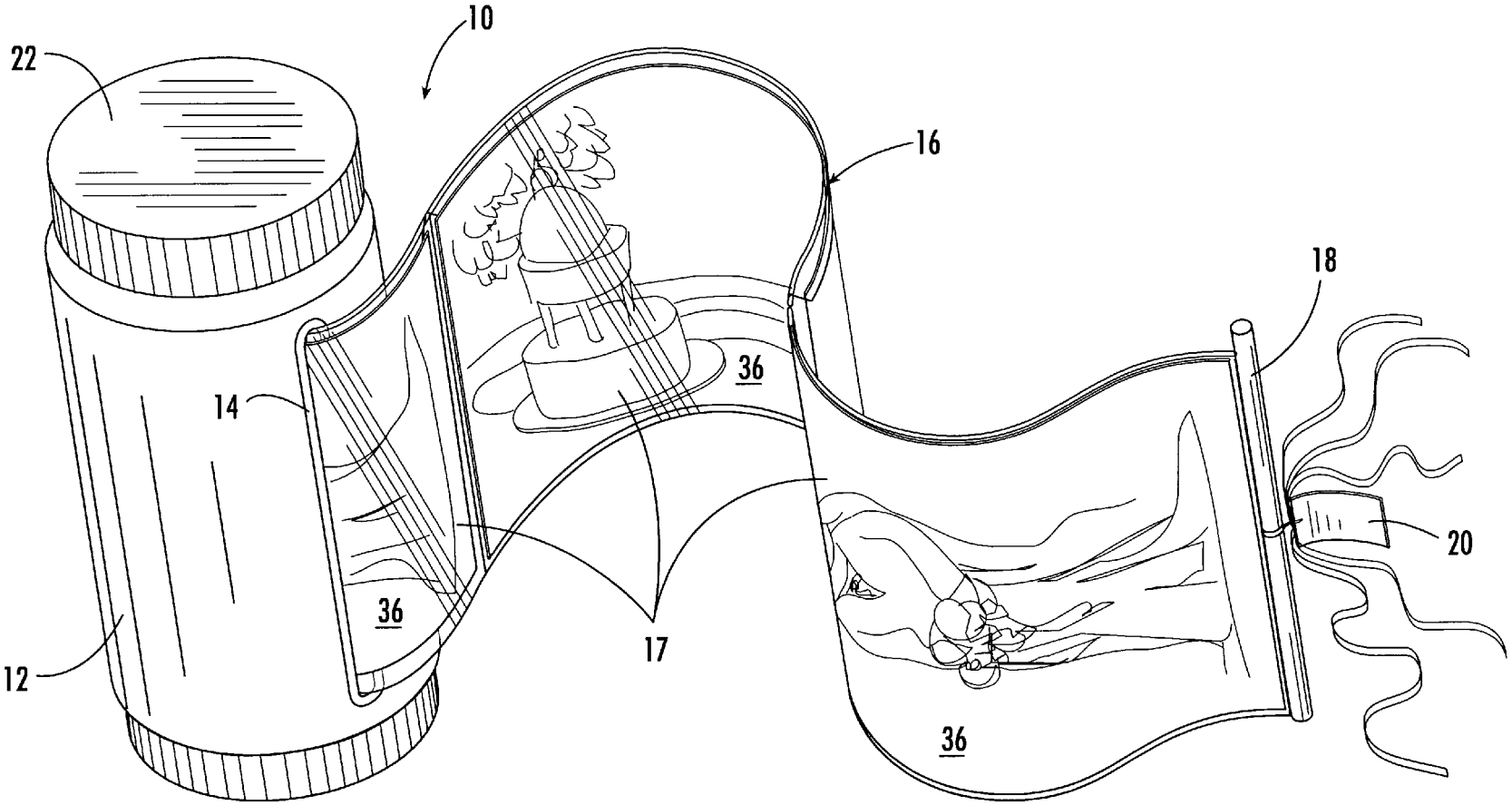
FIG. 7 is a schematic diagram illustrating the gift container of the present invention with the medium carrying photographs and being partially withdrawn from the housing.

The transparency of the plurality of pockets 17 aids in the visual enjoyment and surprise of the recipient while withdrawing the medium 16, and provides for the use of the container 10 as a photo-album where photographs are stored in the pockets, as illustrated in FIG. 7. The photographs are preferably ones taken at the event where the gift 10 was given thereby creating a photo-album memento of the occasion. Of course, if appropriate, the entire pocket 17 or the opposite side of the pocket 17 may be opaque. In this case, the pockets 17 may include a window, such as a cut-out portion to reveal the gift or photograph contained therein. The monetary gift preferably comprises paper money 34, and may also include checks or gift certificates.

A knob 22 is connected to the inner spindle 24 for winding the medium 16 around the inner spindle, and a stop member 18 is attached to a distal end of the medium and disposed outside the chamber 13 for aiding in the withdrawal and winding of the medium. A tab 20 may be connected to the stop member 18 for withdrawing the gift medium from the chamber 13 via the slot-shaped opening 14. For example, the stop member 18 may comprise an elongated stop member which is larger than the slot-shaped opening 14 to retain the distal end of the medium 16 outside the housing 12. Once the recipient has withdrawn the medium 16 from the housing 12 via the slot-shaped opening 14, he/she need only turn the knob 22 to wind the medium back onto the inner spindle 24 in the chamber 13. Of course other knobs and/or winding mechanisms, such as a spring loaded winding mechanism, may also be used as would be appreciated by the skilled artisan.

Also, the greeting card 32 may be connected between the stop member 18 and the length of transparent pockets 17. Alternatively, the greeting card 32 may be contained in at least one of the plurality of transparent pockets 17. The housing 12 is generally cylindrically shaped, for example, and may include decorative indicia on the outer surface thereof. Of course, the housing 12 may be formed of other shapes which would be appropriate for accommodating a spindle mechanism and the medium 16 while enhancing the appearance of the gift container 10. Furthermore, the housing 12, the inner spindle 24 and the knob 22 may be formed of plastic.

Figure 3:
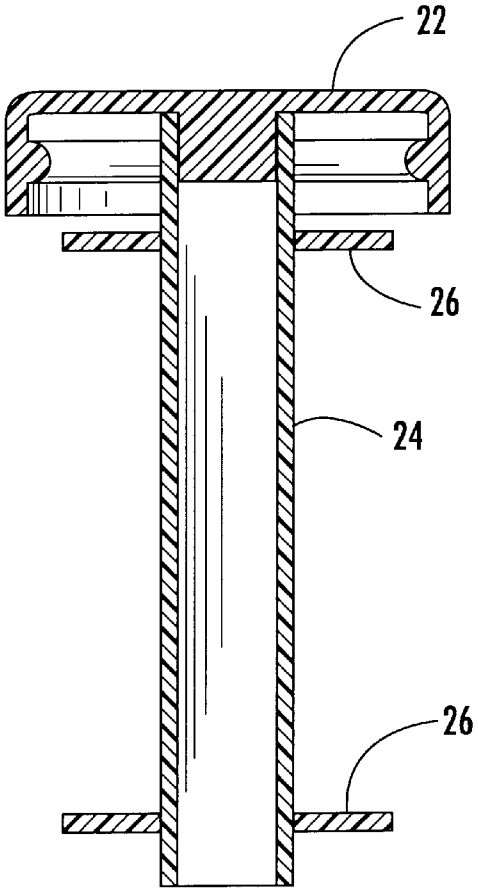
FIG. 3 is a cross-sectional view of the spindle and knob of the container of FIG. 1.
Figure 2:
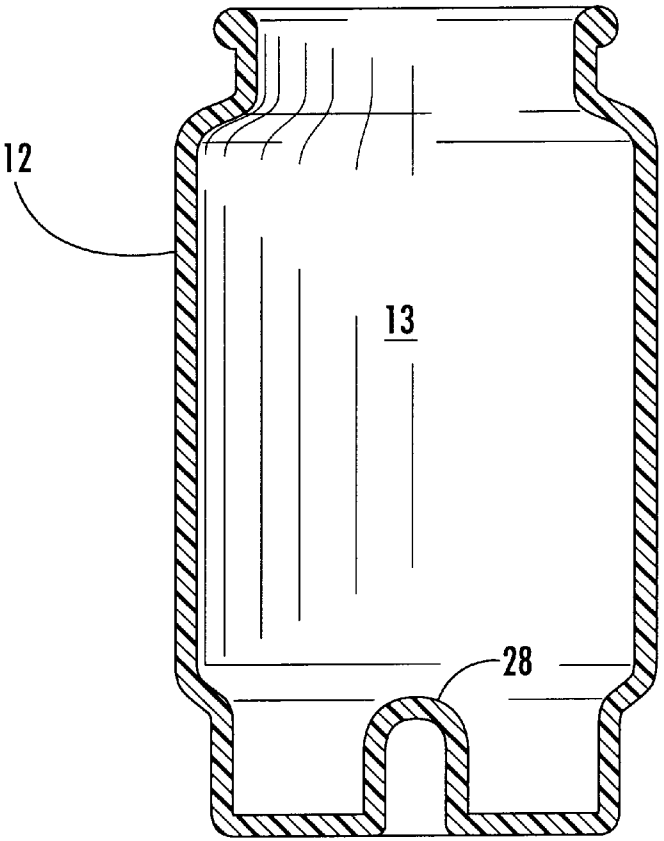
FIG. 2 is a cross-sectional view of the housing of the container of FIG. 1.
Figure 5:
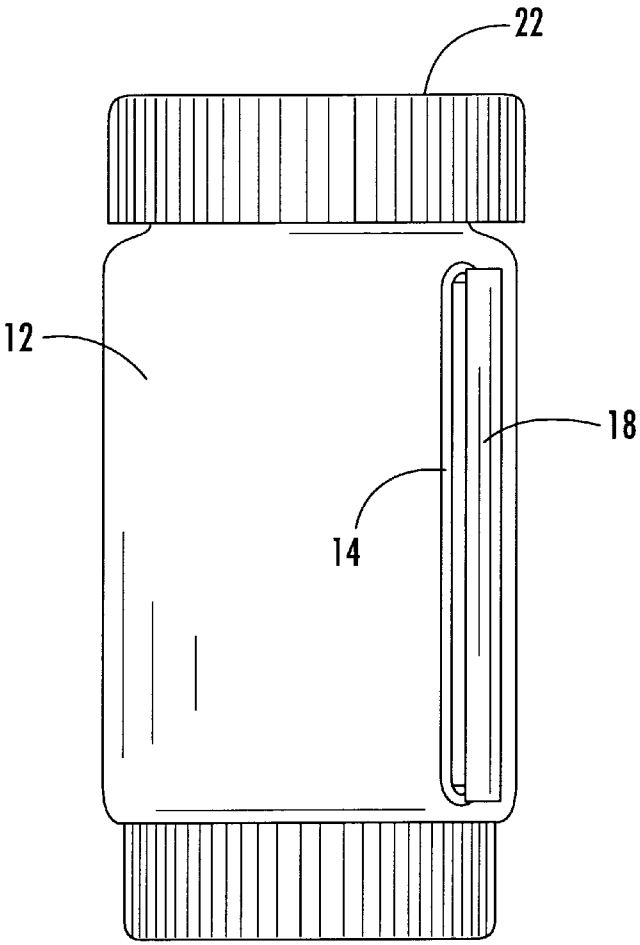
FIG. 5 is a side view of the container of FIG. 1 with the medium being completely wound inside the housing.
Figure 4:
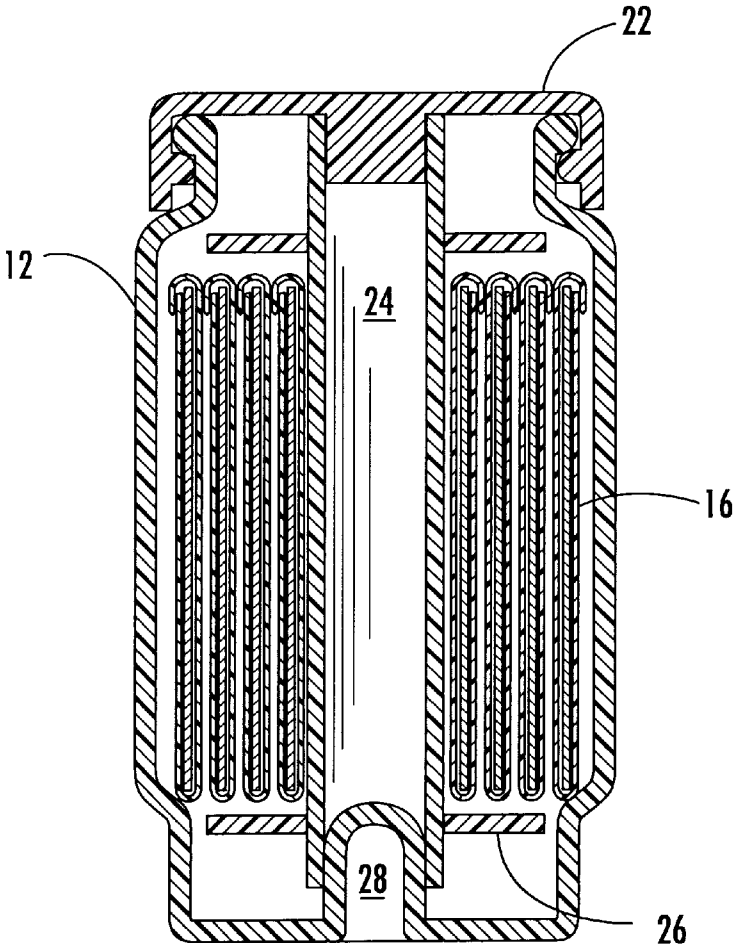
FIG. 4 is a cross-sectional view of the housing, spindle and knob together with the medium of the container of FIG. 1.

As best shown in FIGS. 2–4, the housing 12 includes an internal journal 28 in the chamber 13. The inner spindle 24 is fitted on the journal 28 and secured and the top of the housing 12 via the knob 22. The inner spindle 24 also includes retainers 26 for supporting and guiding the medium 16 when wound onto the inner spindle. Of course other mechanisms, such as bearings, for securing the spindle 24 may be used, and other guide mechanisms, such as a spindle groove, may be used to support and align the medium 16 as would be appreciated by the skilled artisan.

A method aspect of the present invention is directed to making the combination gift container and photo album 10. The method includes forming the housing 12 defining a chamber 13 therein, forming a slot-shaped opening 14 in an outer surface of the housing and in communication with the chamber, providing an inner spindle 24 in the chamber, and connecting a medium 16 to the inner spindle to be wound around the inner spindle and withdrawn from the chamber via the slot-shaped opening in the outer surface of the housing. Again, the medium 16 includes a greeting card 32, and a plurality of pockets 17 connected together lengthwise. Each of the pockets 17 has an appropriate size to selectively receive a monetary gift and a photograph as shown in FIGS. 1 and 7. The method further includes connecting a winding device or knob 22 to the inner spindle 24 for winding the medium 16 around the inner spindle, and attaching a stop member 18 to the distal end of the medium outside the chamber for aiding in the withdrawal and winding of the medium.

As discussed above, the monetary gift preferably includes at least one of paper money 34, checks and gift certificates. Also, a tab 20 may be connected to the stop member 18 for withdrawing the gift medium 16 from the chamber 13 via the slot-shaped opening 14, and the stop member may comprise an elongated stop member which is larger than the slot-shaped opening. The greeting card 32 may be contained in at least one of the plurality of transparent pockets 17 or connected between the plurality of transparent pockets and the stop member 18. Decorative indicia may be formed on the outer surface of the housing 12, and the housing, the inner spindle 24 and the knob 22 may be formed of plastic.

Thus, a giver of the gift container 10 would sign the greeting card 32 and place a desired number of bills 34, for example, such as $5's, $10's, $20's etc., in the transparent pockets 17 before winding the medium 16 onto the spindle 24 and inside the chamber 13. The recipient of the gift would pull the stop-member 18 and/or tab 20 to withdraw the medium 16 while reading the greeting card 32 and seeing the money 34 contained in the pockets. After taking the money 32 out of the pockets 17, the recipient may then insert photographs 36 from the occasion in the pockets 17 so that the gift container 10 becomes a photo-album memento of the occasion.

Thus, the invention provides a gift container 10 for enclosing money 34, checks and/or gift certificates in a way that surprises the recipient, which includes a greeting card 32, which is simple to make and use, and which can be readily used as a photo-album memento of the occasion.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A combination gift container and photo album comprising:

a cylindrical housing defining a chamber therein and including a slot-shaped opening in an outer surface thereof and in communication with the chamber, the housing having a reduced diameter open end portion terminating in an outwardly extending lip, a closed end, and a projection extending into the chamber at the closed end, the open end portion defining a circular opening having a first diameter;

a tubular spindle carried by the housing in the chamber and having a first end rotatably received over the projection, the tubular spindle including upper and lower retaining members each having a second diameter which is less than the first diameter of the opening defined by the open end portion of the housing;

a medium wound on the tubular spindle between the upper and lower retaining members to be withdrawn from the chamber via the slot-shaped opening in the outer surface of the housing, the medium comprising a plurality of transparent pockets connected together lengthwise, each of the pockets having an appropriate size to selectively receive a photograph and a monetary gift comprising at least one of paper money, checks and gift certificates;

a greeting card contained in at least one of the plurality of transparent pockets which is closest the distal end of the medium;

a knob comprising an end portion fixedly connected to a second end of the spindle, a generally cylindrical sidewall depending from the end portion, and a ridge carried by and extending inwardly from the generally cylindrical sidewall to cooperate with the lip so that the knob is rotatably retained over the reduced diameter open end portion of the housing; and a stop member attached to a distal end of the medium and disposed outside the chamber for aiding in the withdrawal and winding of the medium.

2. A gift container according to claim 1 further comprising a tab connected to the stop member for withdrawing the gift medium from the chamber via the slot-shaped opening.

3. A gift container according to claim 1 wherein the stop member comprises an elongated stop member which is larger than the slot-shaped opening.

4. A gift container according to claim 1 wherein the outer surface of the housing includes decorative indicia.

5. A gift container according to claim 1 wherein the housing comprises plastic.

6. A method of making a combination gift container and photo album, the method comprising:

forming a cylindrical housing defining a chamber therein, the housing having a reduced diameter open end portion terminating in an outwardly extending lip, a closed end, and a projection extending into the chamber at the closed end, the open end portion defining a circular opening having a first diameter;

forming a slot-shaped opening in an outer surface of the housing and in communication with the chamber;

providing a tubular spindle carried by the housing in the chamber and having a first end rotatably received over the projection, the tubular spindle including upper and lower retaining members each having a second diameter which is less than the first diameter of the opening defined by the open end portion of the housing;

winding a medium on the tubular spindle between the upper and lower retaining members to be withdrawn from the chamber via the slot-shaped opening in the outer surface of the housing, the medium comprising a greeting card, and a plurality of pockets connected together lengthwise, each of the pockets having an appropriate size to selectively receive a monetary gift and a photograph;

providing a knob comprising an end portion fixedly connected to a second end of the spindle, a generally cylindrical sidewall depending from the end portion, and a ridge carried by and extending inwardly from the generally cylindrical sidewall to cooperate with the lip so that the knob is rotatably retained over the reduced diameter open end portion of the housing; and attaching a stop member to the distal end of the medium outside the chamber for aiding in the withdrawal and winding of the medium.

7. A method according to claim 6 wherein the the size of each of the pockets is between about 2–4 inches high and 4–8 inches long for receiving the monetary gift which comprises at least one of paper money, checks and gift certificates.

8. A method according to claim 6 further comprising connecting a tab to the stop member for withdrawing the gift medium from the chamber via the slot-shaped opening.

9. A method according to claim 6 wherein the stop member comprises an elongated stop member which is larger than the slot-shaped opening.

10. A method according to claim 6 wherein the greeting card is contained in at least one of the plurality of pockets.

11. A method according to claim 6 wherein the greeting card is connected between the plurality of pockets and the stop member.

12. A method according to claim 6 wherein the plurality of pockets are transparent.

13. A method according to claim 6 wherein the housing, the tubular spindle and the knob are formed of plastic.

* * * * *